United States Patent [19]

Johnson et al.

[11] Patent Number: 4,669,242

[45] Date of Patent: Jun. 2, 1987

[54] APPARATUS FOR LINING FURNACE WALLS

[75] Inventors: Steven L. Johnson, Blue Springs; Martin E. Adams, Kansas City; James P. Leffingwell, Aurora; John J. Musser, Kansas City, all of Mo.; William H. Hedges, Kingwood, Tex.; Thomas L. Robberts, Lake Charles, La.

[73] Assignee: Geo. P. Reintjes Co., Inc., Kansas City, Mo.

[21] Appl. No.: 636,628

[22] Filed: Aug. 1, 1984

[51] Int. Cl.[4] ..... E04B 1/74

[52] U.S. Cl. ..... 52/404; 29/432; 29/446; 29/423; 29/526 R; 52/406; 206/321; 206/303

[58] Field of Search ..... 52/127.1, 127.7, 404, 52/509, 506, 227, 747; 206/322, 321, 303; 110/131; 29/446, 432, 526 R, 455 R

[56] References Cited

U.S. PATENT DOCUMENTS

| | | | |
|---|---|---|---|
| 3,446,419 | 5/1969 | Mueller | 206/303 X |
| 3,521,742 | 7/1970 | Ferrell | 206/321 |
| 3,832,815 | 9/1974 | Balaz | 52/506 X |
| 3,854,262 | 12/1974 | Brady | 52/404 |
| 3,958,385 | 5/1976 | Bondro, Jr. et al. | 52/404 |
| 4,122,949 | 10/1978 | Blatt | 206/303 |
| 4,123,886 | 11/1978 | Byrd | 52/509 |
| 4,129,972 | 12/1978 | Sherman et al. | 52/404 X |
| 4,287,839 | 9/1981 | Severin | 110/331 |
| 4,339,902 | 7/1982 | Cimochowski | 52/506 |
| 4,516,374 | 5/1985 | Finney | 52/509 X |

OTHER PUBLICATIONS

Johns-Manville Refractory Products Z-Blok Glue on Modules The Proven Leader-3/80.

The Carborundum Company Insulation Division Fiberfrax Durablanket Strip-2/81.

Johns-Manville Refractory Products Z-Blok Refractory Fiber, Modules: Better Than Layered Construction in Many Ways-2/81.

The Insulator AB&W Newsletter for Dealers and Installers, Apr. 1982.

Manville Refractory Fiber Module System Helps Reduce Crude Heater Downtime Reprinted from Jun. 1982, Chemical Processing.

Sauder Energy Systems The Inventor of PYRO-BLOC Ceramic Fiber Modules.

Industrial Heating-Tips on Improving Process Furnace Energy Efficiency-12/82.

Industrial Heating-Furnace Veneering Systems of Special Design Help Achieve Energy Reduction Goals at Armco-12/82.

Industrial Heating-Ceramic Refractory Coatings-Their Application and Performance-12/82.

National Petroleum Refiners Assoc., "New Developments in Refractory Linings", 2/83.

Babcock & Wilcox-"Introducing a family of weld-on modules that's easy to get attached to".

*Primary Examiner*—Charlie T. Moon

*Attorney, Agent, or Firm*—Schmidt, Johnson, Hovey & Williams

[57] ABSTRACT

A method of lining the hot face of the wall of a heated enclosure, such as a furnace, boiler or the like, comprising the steps of compressing a plurality of substantially cylindrical modules of ceramic fiber material inwardly from the perimeter thereof; attaching the individual, compressed modules to the hot face of the wall in predetermined relationship whereby to define certain openings therebetween, inspecting the attaching means by virtue of the access thereto provided by the openings; filling the openings with a plug of ceramic fiber material; and then releasing the compression upon the modules to permit radial expansion thereof in all directions whereby to create a lining over the entire wall. The apparatus to achieve the method consists of a plurality of initially compressed modules of ceramic fiber material; means for attaching the compressed modules to the wall, in the form of a stud welded to the wall, a bracket carried by the stud and legs on the bracket which receive and hold a rod extending through each of the modules; there being means for retaining the modules in their initially compressed condition in the form of a casing which is octagonal in configuration and is placed over the module when it is initially compressed, the casing being removed after the module has been placed on the wall, the attaching means inspected and the openings filled by the plug of material whereby the modules each expand radially outwardly to cooperate with the plugs to line the wall.

10 Claims, 4 Drawing Figures

APPARATUS FOR LINING FURNACE WALLS

BACKGROUND OF THE INVENTION

1. Field of the Invention

The method and apparatus described herein relates to providing protection for the walls of heated enclosures such as furnaces, boilers and the like and wherein an insulation protection for the wall is desired. This is achieved through the use of a plurality of modules and plugs formed from ceramic fiber material, which material is especially created for insulating purposes.

2. Background of the Invention

It has been known to utilize ceramic material in various forms and configurations to line the walls of a heated enclosure but the manner of doing so has not taken maximum advantage of the inherent characteristics of ceramic fiber but rather has utilized such material in relatively conventional techniques. These techniques have resulted in an incomplete and inferior lining for the hot face of walls of heated enclosures in that the material is not securely attached to the wall; joints open between the modules of material after heating thereof; it is not possible to inspect, prior to heating, the means for attaching the ceramic fiber material to the wall; and there is not a compressive relationship between the pieces of ceramic material which are utilized to line the wall.

SUMMARY OF THE INVENTION

It is the purpose of this invention to provide a method and apparatus for lining the hot face of the walls of a heated enclosure through the use of ceramic material by initially compressing the ceramic material into modules which are substantially cylindrical or octagonal in configuration; retaining the modules in a compressed condition while they are attached to the wall to be lined; and subsequently releasing the compression whereby the compressed ceramic fiber material is free to expand circumferentially in all directions by virtue of its radially outward movement to thereby move the modules into tight fitting engagement one with the other.

Yet further, the compressed modules are originally positioned on the wall in such a pattern that there is an opening at each of the corners or quadrants thereof, the opening permitting access to the means which have been utilized, such as a stud welded to the wall, to secure the attaching bracket to the wall, all to the end that the weldment of the stud to the wall may be inspected prior to finally covering the wall with the lining material.

To retain the module in its initial compressed condition there is provided a casing of octagonal configuration which is placed over the module when it is initially compressed and which is left on the module until such time as it has been attached to the wall; the inspection of all of the attaching means and components has been made; and the openings between the modules are filled with plugs of ceramic fiber material, whereupon the covering casing is removed thereby permitting radially outward expansion of the ceramic fiber material of the module in all directions to thereby fill all of the voids and create tight, compressed joints between the plugs and the modules, all to the end that the lining may be resistant to elevated temperatures normally found in the enclosure which is lined.

An additional feature is that the means for attaching the modules to the wall does not include any metallic element extending from the hot face of the wall to the cold face to create thermoconductivity, as is found in other lining systems but rather the entire attaching bracket is held on the hot face of the wall and is easily available for inspection prior to finally permitting expansion of the modules and thereby finally covering the wall with its lining.

DESCRIPTION OF THE PREFERRED EMBODIMENT

The present method and apparatus involves the use of a ceramic fiber insulating material, such as has theretofore been known, in the lining of the hot face of a wall of a heated enclosure such as for instance a boiler, a furnace or other enclosed area which is defined by walls and which walls require insulation to protect the same from the adverse effects of the elevated temperatures reached within the enclosure.

The ceramic fiber material especially utilized in the application hereinafter described is preferably fabricated by the "spun method" which presents fibers of the material which are longer and less likely to tear and which creates a fluffier module when the module is expanded in the lining, although conventional ceramic fiber material may be used.

In creating the module, a strip of ceramic fiber material is rolled upon itself and into a sustantially cylindrical configuration whereby to present layers of the ceramic material, it being the purpose of this system to fabricate the modules in such a manner that the fibers of the material are circularly parallel to the wall of the enclosure which is being lined by a plurality of modules fabricated from the ceramic fiber material. This reduces shrinkage of the material when it is heated and thereby reduces gaps in the joints between the modules and the plugs, as will be hereinafter referred to, and this, together with the fact that the plugs and modules are compressed into position as a result of their inherent expansion, firmly retains the lining material upon the wall.

Figure 1:
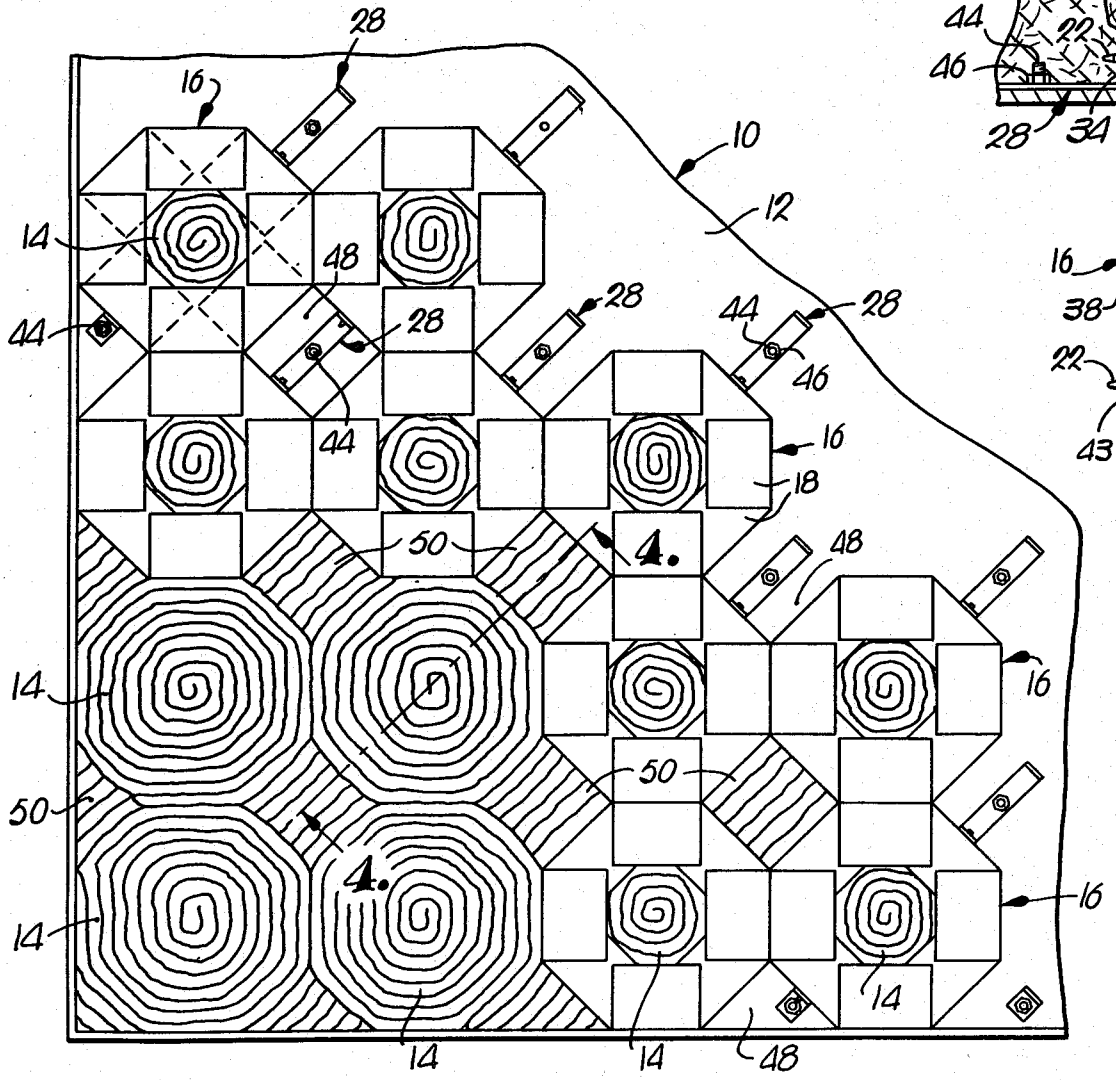
FIG. 1 is a fragmentary elevational view showing the hot face of the wall of the heated enclosure lined with the ceramic fiber modules, some of such modules being in an expanded condition and others being in their initially compressed condition with openings between the modules.

The drawing, in FIG. 1 shows a wall 10 which would be one of a number of walls defining a heated enclosure such a a furnace, boiler or the like, the wall having a normally hot face 12 which is usually the interior surface of the wall 10; that is, the one proximal to the source of heat and, therefore, the one which would reach the highest temperatures as contrasted with the outside or cold face of the wall 10.

It is desirable, in order to maintain and preserve the wall 10, that it be lined with an insulating material and it has been found that ceramic fiber material is very useful for this purpose and has a long life and good heat resistant characteristics.

Figure 2:
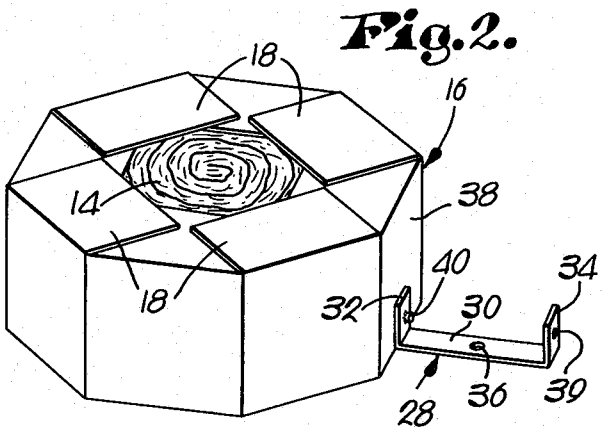
FIG. 2 is a perspective view of a module with the retaining casing thereon and also showing the bracket used to attach the module to the wall.

Accordingly, the lining is created by initially forming a plurality of modules, one such module being individually illustrated in FIG. 2 and broadly designated by the numeral 14. The module 14 is formed from a length or strip of ceramic fiber material, the material being in such form as it comes from the fabrication machine. The strip or length is then rolled upon itself whereby to present the module 14 which is initially of substantially cylindrical configuration and presents a plurality of layers of the material which have been wound upon themselves the desired number of times to form a module which may be readily handled by a worker for installation purposes.

In this regard, it will be appreciated that the modules 14 may be of various different sizes but that it is preferable that all of the modules utilized in a given lining system be of essentially the same dimensions and also that they be of a size so that they may be readily handled by the worker installing the same upon a vertical wall.

Once the module has been initially created by rolling the length of ceramic material upon itself, it is then suitably placed uner compression from all directions whereby to compress the material inwardly toward the center of the module. Such compression may be achieved by a suitable machine or the like which does not form a part of the system herein disclosed, the compression preferably being accomplished at the point of fabrication of the module 14 from the ceramic fiber material.

Once the module 14 has been compressed, it is encased within a retaining casing 16 which may be fabricated from a cardboard, plastic or similar maerial and which is preferably octagonal in geometric configuration, as illustrated for instance in FIG. 2.

One end of the casing 16 is open so that it may be slipped over the compressed module 14 and the other, opposite end, is provided with a plurality of flaps such as 18 which serve to cover the module and further aid in retaining the module 14 in its compressed condition.

Figure 3:
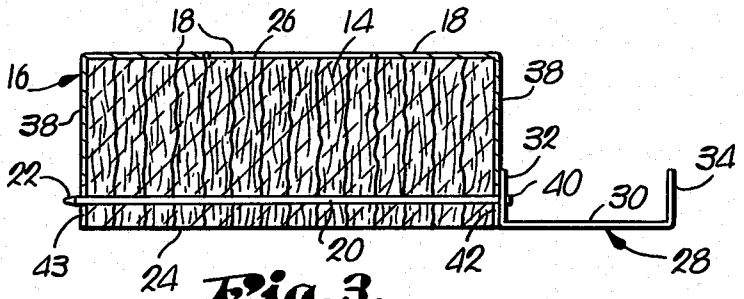
FIG. 3 is a central sectional view taken transversely of the module and showing the rod which extends therethrough.

Once the compressed module 14 has been encased within retaining casing 16, as illustrated in FIGS. 2 and 3 for instance, a rod 20 is passed transversely through the module 14 whereby to span the same a illustrated in FIG. 3 of the drawing. The rod 20 is provided with a sharpened pointed end 22 to facilitate impaling of the module 14 by the rod which may be done manually or automatically at the point of fabrication of the module 14. It is preferable that the rod 20 be approximately 1½ inches from the normally cold face 24 of the module 14. The cold face 24 is that surface of the module 14 which would be next adjacent the hot face 12 of the wall 10 which is being lined and would be contrasted with the hot face 26 of the module 14 which would be that surface of the module which was most proximal to the heat within the enclosure.

Once the retaining casing 16 has been placed over the compressed module 14 and the rod 20 passed through the module, a bracket 28 is affixed to one end of the rod 20 in the manner illustrated in FIG. 3 of the drawing.

Bracket 28 is U-shaped in configuration whereby to present a bight 30 and a pair of opposed, spaced upstanding legs 32 and 34, there being a hole 36 at substantially the center of bight 30. The leg 32 is proximal to a segment 38 of the octagonal retaining casing 16 and receives the end 40 of rod 20 opposite to the pointed end 22 thereof. It will be appreciated that suitable slots are provided in the segments 38 of casing 16 whereby, as will be hereinafter described, the retaining casing 16 may be removed from the compressed module 14 and not disturb the position of the rod 20. Such slots are seen at 42 and 43 for instance, in FIG. 3.

Once the bracket 28 has been secured to the end 40 of rod 20, the compressed module of ceramic fiber material is in condition for application to the hot face 12 of the wall 10 to be lined. It will be appreciated that sufficient number of completed modules, such as shown in FIG. 2, are fabricated to provide enough modules to entirely line the face 12 of wall 10. As indicated, it is preferable that the modules are all of essentially the same size and the fact that the casings 16 are of the same configuration insures that, at least initially, the compressed modules 14 assume an octagonal plan configuration.

The module such as 14 is then lifted to a position overlying a corresponding portion of the hot face 12 of the wall 10 and a pattern of arrangement of the modules is commenced. It will be appreciated that when the first module is positioned over the face 10, the bracket 28 will extend in a given direction therefrom.

As the module 14 and its corresponding bracket 28 are being positioned, the bracket is positioned as shown in FIG. 1 for instance, where it extends outwardly, angularly upwardly from the module 14 whereby to place the leg 34 in a position to receive the pointed end 22 of the rod 20 of the next succeeding module.

Once the position of a module has been determined, and therefore, the position of bracket 28 with respect to the wall 10 and its surface 12, a stud 44 is welded to the wall in a position to extend through the opening 36 in the bight 30 of the bracket 28. Such studs are conventionally readily and quickly attached by automatic stud welding guns, there being a weldment between the metal, threaded stud, and the face 12 of the wall 10, when the wall 10 is of metal, as is usually the case. However, if the wall 10 were to be of a masonry construction, the studs such as 44 could be suitably secured to the masonry wall by known techniques and means.

Once the stud has been so positioned, the bracket 28 is fitted thereover by permitting the stud to extend through the opening 36. A nut and washer are then placed over the stud and the nut 46 is drawn down tightly whereby to secure the module, in its compressed condition, in a vertically positioned relationship upon the hot face 12 of wall 10.

The next similar module 14, in its compressed condition and surrounded by retaining casing 16 is then brought into position upon the wall 10 and the free end of the rod 20 which extends therefrom is inserted in an aperture 39 in leg 34 of the bracket 28 carried by the preceding module. In this regard, it is preferable to initially install a complete horizontal row of the modules, for instance along the lower margin of the face 12 and to then install the next upwardly succeeding row of modules. In installing the modules in this manner, the succeeding row can be readily and quickly positioned merely by inserting the free end 22 of the rod 20 into the aperture 39 which is provided in leg 34 and is specifically intended to receive the free end of the rod 20.

Such a procedure will readily align the compressed modules in horizontal rows extending upwardly over the face 12 of wall 10. Further, alignment and positioning of the compressed modules in their desired pattern will be aided and assisted by the fact that the retaining casing 16 is octagonal and presents eight flattened segment surfaces which may be brought into abutting relationship such as shown for instance in FIG. 1; that is, the segment of one casing may be engaged with the segment of a next upwardly succeeding casing to thereby assist in supporting the uppermost casing.

It will also be appreciated that inasmuch as the studs 44 may be quickly and readily installed by suitable automatic devices, the entire lining of the precompressed, retained modules can be readily and quickly accomplished and, in doing so, the modules are all securely attached to the face 12 by the attaching assembly which consists of the rod 20 and the bracket 28.

Once the compressed modules have been arranged in the pattern described above and illustrated in FIG. 1 of the drawing, it will be appreciated that an opening is presented between respective modules, there being an opening corresponding to alternate segments of the casing 16, all as is shown for instance in FIG. 1, the openings being identified as 48.

Such openings are essentially square in cross-sectional configuration and extend from the hot face 26 of the module 14 to the cold face 24 thereof and thus to the hot face 12 of the wall 10.

It is the primary purpose of such openings to permit access to the attaching means which are retaining the module 14 with respect to the wall 10 to thereby permit inspection of the retaining means prior to the entire wall being lined with the ceramic material This is particularly important inasmuch as it is highly desirable to absolutely insure that the studs 44 are securely welded to the face 12 of the wall 10 and normal procedures require inspection of such welds before the wall is entirely lined or covered with the ceramic material.

Thus, it would be contemplated that, in lining a wall, such as illustrated in FIG. 1, all of the precompressed modules 14 of ceramic material would be installed and attached to the wall 10 by the attaching means described above and that the openings 48 would be permitted to remain until such time as suitable inspection had been made of the welding of the studs 44 to the wall 10 and also the securing of the brackets 28 to the wall by means of the nut 46 and washer (not shown) which are received by the studs 44.

Once such an inspection has been made, each of the openings 48 has placed therein a plug 50 of layered ceramic fiber material, as illustrated, such plugs being initially compressed to fit tightly within their corresponding openings 48 and being then permitted to expand once installed within the openings 48.

Once plugs such as 50 have been placed in all of the openings 48 presented in the lining on a given wall, the retaining casings 16 are then removed individually from each of the compressed modules 14.

When the casings 16 are removed, as by pulling the same outwardly and slipping them off of the compressed modules, it will be appreciated that the compressed material which defines each of the modules will, due to its inherent characteristics, expand in a radially outward, circumferentially extending direction, whereby the material expands in a full 360° direction once it has been removed from restraint by the casing 16.

Figure 4:
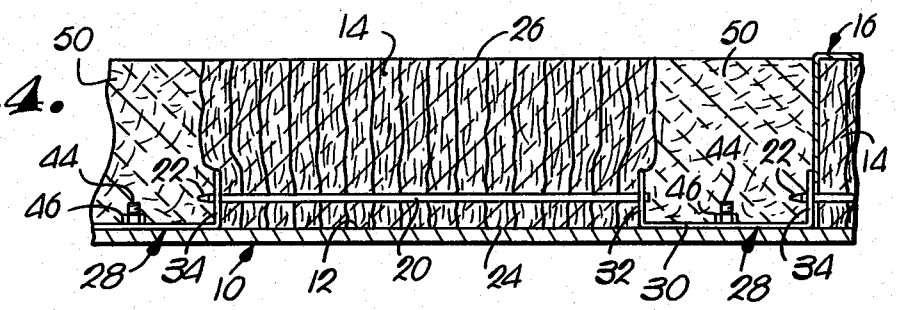
FIG. 4 is a sectional view taken on line 4—4 of FIG. 1 and showing a module, the attaching means therefor and the plugs which fill the openings adjacent the module, all in an expanded condition.

Such expansion of the compressed modules into the uncompressed condition as shown in FIG. 4 for instance, insures that the joints between the modules themselves and the plugs next adjacent thereto will be tight and secure joints and will be capable of withstanding elevated temperatures without gapping open and requiring repair.

Thus, a continuous tightly covering lining is provided for the hot face 12 of the wall 10.

Furthermore, the means of attaching the lining to the surface 12 is entirely on the hot face 12 of the wall 10 and does not extend therethrough whereby there is no thermoconductivity or transmission from the hot face 12 of the wall 10 to the opposite or cold face thereof.

Furthermore, and as hereinabove referred to, it is desirable that the ceramic fiber material utilized to fabricate the modules 14 be fabricated by the spin method and that the fibers in the ceramic fiber material be positioned in a perpendicular relationship to the face 12 of wall 10. Such fabrication and positioning takes maximum advantage of the inherent characteristics of the ceramic fiber insulating material.

It has been found, by testing, that a wall system installed through the method and apparatus hereinabove described, exhibits tightness of its joints even after service in excess of temperatures ranging upwardly to 2000°. Thus the joints between the expanded modules 14 and the adjacent expanded plugs 50 are still tight and serve their function in protecting the face 12 of the wall 10 from the destructive effects of the heat within the enclosure which has been lined in the manner and by the system hereinabove described.

It will be readily appreciated that the retaining casings 16 may be again used for similar purposes; that is, once they have been removed from their retaining relationship with a module 14 they may be again used to compress a similar module. In removing the casing 16, such may be accomplished by folding the flaps 18 outwardly to provide a hand hold to grip the casing 16 and slip it outwardly from its encompassing relationship to the then compressed module 14 to thereby permit expansion of the module in all directions to complete the wall lining of ceramic fiber material.

We claim:

1. Thermal insulating apparatus adapted to be affixed to a wall of a furnace or like structure, the wall having a hot face and a cold face, said thermal insulating apparatus comprising:

a plurality of initially radially compressed, substantially cylindrical modules of ceramic fiber material;

means for supporting said compressed modules and for attaching said compressed modules to the hot face of said wall, said means for attaching the compressed modules to the wall including a rod extending through the module and opposed brackets each receiving an end of the rod, the brackets being abuttingly securable to the wall on opposite sides of the module, said brackets being U-shaped whereby to present a bight and a pair of spaced legs, the bight being abuttingly securable to the wall, the legs extending outwardly therefrom, one leg of each of the opposed brackets receiving the end of a rod which extends through a given module; and means for partially encasing said modules to retain the same in their initially radially compressed condition during attachment thereof to the hot face of the wall, said means being removable for permitting subsequent expansion of the modules after attachment of the modules to the hot face and removal of the encasing means.

2. Apparatus as set forth in claim 1, said modules being initially (uniformly) compressed inwardly toward the center thereof by said encasing and retaining means and expansible uniformly outwardly from the center thereof when said retaining means is removed.

3. Apparatus as set forth in claim 2, said modules being in the form of a strip of ceramic fiber material having a length greater than its width and rolled upon itself to present multiple layers of the material from the center of the module outwardly each layer presenting a pair of opposed edges, the edges being separated by the width of the material, one group of edges constituting the hot face of the module and the other group constituting the cold face of the module, the cold face of the module being in engagement with the hot face of the wall.

4. Apparatus as set forth in claim 1, said encasing and retaining means being octagonal in configuration whereby to compress and retain the module in an octagonal plan configuration prior to attachment of the module to the wall.

5. Apparatus as set forth in claim 4, said encasing and retaining means being in the form of a casing which surrounds the module.

6. Apparatus as set forth in claim 4, said modules being attachable to the hot face of said wall in a pattern presenting an opening between the modules at essentially each corner of each module, said openings permitting access to the means for attaching the modules to the wall.

7. Apparatus as set forth in claim 6, said attaching means including a stud weldable to the wall for securing said attaching means to the furnace wall, said stud being accessible through said openings while said modules are retained in their initially compressed condition, whereby to permit inspection of the stud and its weldment to the wall.

8. Apparatus as set forth in claim 6, there being a plug of ceramic fiber material for each of said openings, said plugs being positioned in the openings prior to permitting expansion of the modules.

9. Apparatus as set forth in claim 8, said plugs being of essentially the same thickness as said modules.

10. Apparatus as set forth in claim 9, said modules and said plugs cooperating to entirely cover the wall and the means for attaching the modules to the wall once expansion of the modules has been permitted by removal of the encasing and retaining means.

* * * * *